US009216749B2

(12) United States Patent
Itagaki et al.

(10) Patent No.: US 9,216,749 B2
(45) Date of Patent: Dec. 22, 2015

(54) OCCUPANCY DETECTION DEVICE AND OCCUPANCY DETECTION METHOD

(71) Applicant: KYOSAN ELECTRIC MFG. CO., LTD., Yokohama-shi, Kanagawa (JP)

(72) Inventors: Tomonori Itagaki, Kawasaki (JP); Kaoru Oshima, Tokyo (JP); Tamotsu Yokoyama, Yokohama (JP); Kenji Mizuno, Sagamihara (JP)

(73) Assignee: KYOSAN ELECTRIC MFG. CO., LTD., Yokohama-shi, Kanagawa (JP)

( * ) Notice: Subject to any disclaimer, the term of this patent is extended or adjusted under 35 U.S.C. 154(b) by 287 days.

(21) Appl. No.: 13/960,944

(22) Filed: Aug. 7, 2013

(65) Prior Publication Data

US 2014/0117169 A1 May 1, 2014

Related U.S. Application Data

(63) Continuation of application No. PCT/JP2012/077683, filed on Oct. 26, 2012.

(51) Int. Cl.

| | |
|---|---|
| ***B61L 1/02*** | (2006.01) |
| ***B61L 1/10*** | (2006.01) |
| ***B61L 3/12*** | (2006.01) |

(Continued)

(52) U.S. Cl.

CPC ... *B61L 1/02* (2013.01); *B61L 1/10* (2013.01); *B61L 3/125* (2013.01); *B61L 25/025* (2013.01); *B61L 27/0077* (2013.01)

(58) Field of Classification Search

CPC ..... B61L 1/02; B61L 1/10; B61L 3/121; B61L 3/125; B61L 25/025; B61L 27/0077

USPC ..... 246/20, 27, 28 R, 34, 122 R

See application file for complete search history.

(56) References Cited

U.S. PATENT DOCUMENTS

| | | | | |
|---|---|---|---|---|
| 5,803,411 | A * | 9/1998 | Ackerman et al. | 246/169 R |
| 7,099,754 | B2 * | 8/2006 | Sugita et al. | 701/19 |

(Continued)

FOREIGN PATENT DOCUMENTS

| | | | |
|---|---|---|---|
| JP | 2005-178667 | A | 7/2005 |
| JP | 2008-126721 | A | 6/2008 |
| JP | 4575807 | B2 | 8/2010 |

OTHER PUBLICATIONS

International Search Report of the International Searching Authority mailed Jan. 15, 2013 for the corresponding international application No. PCT/JP2012/077683.

*Primary Examiner* — Zachary Kuhfuss

(74) *Attorney, Agent, or Firm* — Muncy, Geissler, Olds & Lowe, P.C.

(57) ABSTRACT

An onboard system transmits a train occupancy range based on a measured train position to a ground system. The ground system provisionally detects the occupancy state of each block section based on the train occupancy range acquired from the onboard system. Exit detection points (Qh, Qr) are set at a position outside each block section. It is determined that the train has left the block section when the entirety of the train occupancy range has passed the exit detection point (Qh, Qr). When the provisional detection result indicates that the detection target block section is not occupied, and it has been determined that the train has left the detection target block section, it is determined that the detection target block section is not occupied.

7 Claims, 12 Drawing Sheets

(51) Int. Cl.
*B61L 25/02* (2006.01)
*B61L 27/00* (2006.01)

(56) References Cited

U.S. PATENT DOCUMENTS

2005/0010338 A1* 1/2005 Kraeling et al. ..... 701/19
2005/0133673 A1 6/2005 Sugita et al.
2005/0240322 A1* 10/2005 Peltz et al. ..... 701/19
2014/0117168 A1* 5/2014 Itagaki et al. ..... 246/34 R
2014/0209752 A1* 7/2014 Myokei ..... 246/27
2014/0209753 A1* 7/2014 Takahashi et al. ..... 246/122 R
2014/0209755 A1* 7/2014 Takahashi et al. ..... 246/167 R
2014/0209758 A1* 7/2014 Kurita ..... 246/2 S
2014/0209759 A1* 7/2014 Tsukamoto ..... 246/2 S
2014/0209760 A1* 7/2014 Tsukamoto ..... 246/2 S
2014/0209761 A1* 7/2014 Kurita ..... 246/29 R
2014/0214247 A1* 7/2014 Myokei ..... 701/19

* cited by examiner

[TRAIN OCCUPANCY RANGE]

[OCCUPANCY DETERMINATION]

(1)BEFORE CORRECTION (2)AFTER CORRECTION

[WHEN TRAIN LEAVES BLOCK SECTION]

FIG. 10

520

521 522 523

| BLOCK SECTION | START POINT POSITION | END POINT POSITION |
|---|---|---|
| 1T | L1 | L2 |
| 2T | L2 | L3 |
| 3T | L3 | L4 |
| ⋮ | ⋮ | ⋮ |

[BLOCK SECTION SETTING INFORMATION]

FIG. 11

550

551 552

| BLOCK SECTION | PROVISIONAL OCCUPANCY STATE |
|---|---|
| 1T | UNOCCUPIED |
| 2T | OCCUPIED |
| 3T | UNOCCUPIED |
| ⋮ | ⋮ |

[PROVISIONAL OCCUPANCY INFORMATION]

FIG. 12

560

561

562

| BLOCK SECTION | DETERMINED OCCUPANCY STATE |
|---|---|
| 1T | OCCUPIED |
| 2T | UNOCCUPIED |
| 3T | UNOCCUPIED |
| ⋮ | ⋮ |

[DETERMINED OCCUPANCY INFORMATION]

FIG. 13

530

531

532

533

| BLOCK SECTION | BACKWARD EXIT DETECTION POINT Qr | FORWARD EXIT DETECTION POINT Qh |
|---|---|---|
| 1T | L11 | L12 |
| 2T | L21 | L22 |
| 3T | L31 | L32 |
| ⋮ | ⋮ | ⋮ |

[DETECTION POINT SETTING INFORMATION]

OCCUPANCY DETECTION DEVICE AND OCCUPANCY DETECTION METHOD

CROSS REFERENCE TO RELATED APPLICATION

This application is a continuation of International Patent Application No. PCT/JP2012/077683, having an international filing date of Oct. 26, 2012, which designated the United States, the entirety of which is incorporated herein by reference.

BACKGROUND

In recent years, development of the Communications-Based Train Control (CBTC) system that does not require a track circuit has progressed. The CBTC system is configured so that an onboard system measures position information about the train, and transmits the position information to a ground system via wireless communication, and the ground system detects the position of the train based on the position information to control the train.

The onboard system detects the train position by measuring the rotational speed of a tacho-generator attached to the axle, for example, and the measured train position contains a measurement error. A technique that utilizes a range obtained by adding a margin distance (train length correction value) to the actual train length when detecting occupancy using the ground system has been proposed (see Japanese Patent No. 4575807, for example).

A technique has been generally used that corrects the train position based on the installation position (absolute position) of a correction coil acquired through communication with the correction coil when the train passes by the correction coil provided along the track in order to reduce a measurement error of the train position measured by the onboard system.

When correcting the train position by utilizing the correction coil, the train position may change (i.e., may be shifted forward/backward) due to correction. The ground system of the CBTC system determines whether or not each block section is occupied by a train based on the train position received from the onboard system. However, a change in train position due to correction may pose a problem when determining whether or not each block section is occupied by a train.

Specifically, when the train position measured by the onboard system precedes the actual train position, the train position is corrected backward when the train has passed by the correction coil. For example, when the rear end of the train that has been present within a second block section that follows a first block section is returned to the first block section due to backward correction, it is determined that the first block section is not occupied before correction, but is occupied after correction. Specifically, the first block section that has been detected to be unoccupied by the train that travels forward is occupied by the train again. In this case, the following train that is entering the first block section must be stopped rapidly since the following train is not allowed to enter the first block section. The above problem also occurs when the train position is corrected forward.

SUMMARY

According to a first aspect of the invention, there is provided an occupancy detection device that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection device comprising:

an acquisition section that acquires a train occupancy range that is determined based on the train position, the train occupancy range being a range in which the train may be present;

a provisional detection section that provisionally detects the occupancy state of each block section based on the train occupancy range;

a detection point passage determination section that determines whether or not the entirety of the train occupancy range has passed a detection point that is provided within a second block section adjacent to a first block section at a position away from a boundary between the first block section and the second block section by a given distance; and a determination section that determines the occupancy state of the first block section using a detection result of the provisional detection section and a determination result of the detection point passage determination section.

According to a second aspect of the invention, there is provided an occupancy detection method that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection method comprising:

provisionally detecting the occupancy state of each block section based on a train occupancy range that is determined based on the train position, the train occupancy range being a range in which the train may be present;

determining whether or not the entirety of the train occupancy range has passed a detection point that is provided within a second block section adjacent to a first block section at a position away from a boundary between the first block section and the second block section by a given distance; and determining the occupancy state of the first block section using a result of the provisionally detection and a determination result as to whether or not the entirety of the train occupancy range has passed a detection point.

BRIEF DESCRIPTION OF THE DRAWINGS

FIG. 10 illustrates a data configuration example of block section setting information.

FIG. 11 illustrates a data configuration example of provisional occupancy information.

FIG. 12 illustrates a data configuration example of determined occupancy information.

FIG. 13 illustrates a data configuration example of detection point setting information.

DESCRIPTION OF EXEMPLARY EMBODIMENTS

Figure 1:
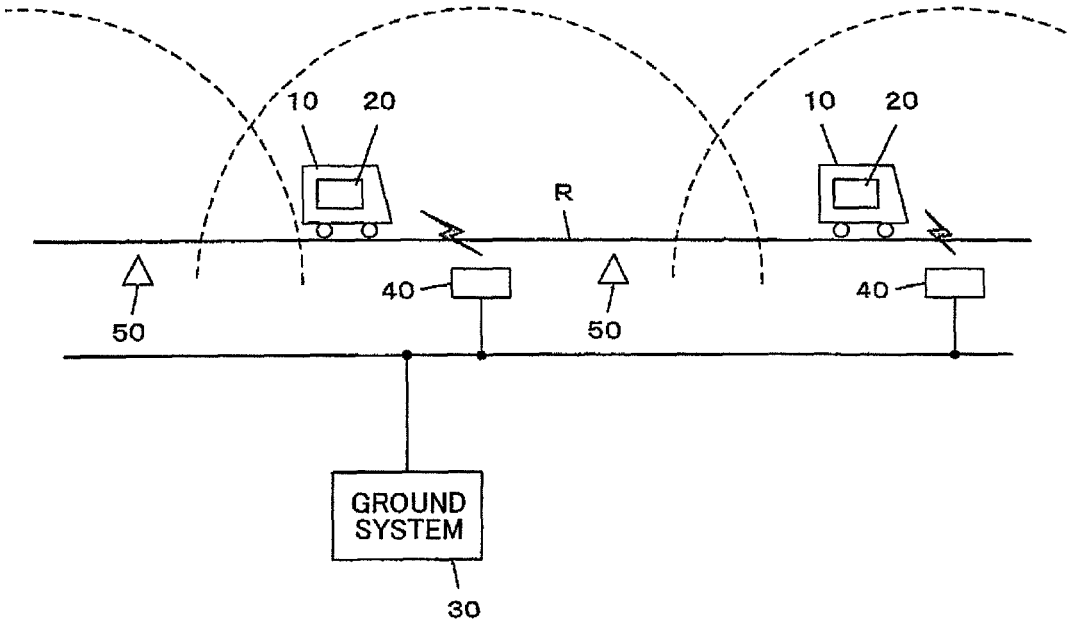
FIG. 1 is a view illustrating the configuration of a wireless train control system.

According to one embodiment of the invention, there is provided an occupancy detection device that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection device comprising:

an acquisition section that acquires a train occupancy range that is determined based on the train position, the train occupancy range being a range in which the train may be present;

a provisional detection section that provisionally detects the occupancy state of each block section based on the train occupancy range;

a detection point passage determination section that determines whether or not the entirety of the train occupancy range has passed a detection point that is provided within a second block section adjacent to a first block section at a position away from a boundary between the first block section and the second block section by a given distance; and a determination section that determines the occupancy state of the first block section using a detection result of the provisional detection section and a determination result of the detection point passage determination section.

According to another embodiment of the invention, there is provided an occupancy detection method that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection method comprising:

provisionally detecting the occupancy state of each block section based on a train occupancy range that is determined based on the train position, the train occupancy range being a range in which the train may be present;

determining whether or not the entirety of the train occupancy range has passed a detection point that is provided within a second block section adjacent to a first block section at a position away from a boundary between the first block section and the second block section by a given distance; and determining the occupancy state of the first block section using a result of the provisionally detection and a determination result as to whether or not the entirety of the train occupancy range has passed a detection point.

According to the above configuration, the occupancy state of the first block section is determined using the provisional detection result for the occupancy state of each block section based on the train occupancy range, and the determination result as to whether or not the entirety of the train occupancy range has passed the detection point that is provided within the second block section adjacent to the first block section.

The occupancy detection device may further comprise:

an occupancy change detection section that detects whether or not the provisional detection section has detected that the occupancy state of the first block section has changed from an occupied state to an unoccupied state, the determination section may include an exit determination section that 1) determines that the train has not left the first block section when the detection point passage determination section has determined that the entirety of the train occupancy range has not passed the detection point, and 2) determines that the train has left the first block section when the detection point passage determination section has determined that the entirety of the train occupancy range has passed the detection point, after the occupancy change detection section has detected that the provisional detection section has detected that the occupancy state of the first block section has changed from the occupied state to the unoccupied state, and the determination section may determine that the first block section is occupied until the exit determination section determines that the train has left the first block section after the occupancy change detection section has detected that the provisional detection section has detected that the occupancy state of the first block section has changed from the occupied state to the unoccupied state.

According to the above configuration, the occupancy state of the first block section is determined as described below. Specifically, it is determined that the first block section is occupied until it is determined that the train has left the first block section after it has been provisionally detected that the occupancy state of the first block section has changed from the occupied state to the unoccupied state. It is determined that the train has not left the first block section when the train occupancy range has not passed the detection point, and determined that the train has left the first block section when the entirety of the train occupancy range has passed the detection point. Specifically, it is determined that the first block section is occupied until it is determined that the entirety of the train occupancy range has passed the detection point provided within the second block section even if it has been provisionally detected that the first block section is occupied since the train occupancy range is situated outside the first block section.

This prevents a situation in which the block section that has been detected to be unoccupied by the train that travels forward is occupied by the train again due to backward position correction using the correction coil.

In the occupancy detection device, the second block section may be a block section that is adjacent to the first block section in a forward travel direction of the train, the occupancy detection device may further comprise a forward-travel detection section that detects whether or not the train travels forward based on a change in the train occupancy range, the detection point passage determination section may determine whether or not the entirety of the train occupancy range has passed the detection point based on the occupancy state of the second block section detected by the provisional detection section, and a positional relationship between a rear end position of the train occupancy range and the detection point, and the exit determination section may determine whether or not the train that travels forward has left the first block section.

According to the above configuration, when the train travels forward, whether or not the entirety of the train occupancy range has passed the detection point is determined based on the positional relationship between the rear end position of the train occupancy range and the detection point that is provided within the second block section adjacent to the first block section in the forward travel direction of the train. It is determined that the train that travels forward has left the first block section when it has been determined that the entirety of the train occupancy range has passed the detection point.

In the occupancy detection device, the second block section may be a block section that is adjacent to the first block section in a backward travel direction of the train, the occupancy detection device may further comprise a backward-travel detection section that detects whether or not the train travels backward based on a change in the train occupancy range, the detection point passage determination section may determine whether or not the entirety of the train occupancy range has passed the detection point based on the occupancy state of the second block section detected by the provisional detection section, and a positional relationship between a front end position of the train occupancy range and the detection point, and the exit determination section may determine whether or not the train that travels backward has left the first block section.

According to the above configuration, when the train travels backward, whether or not the entirety of the train occupancy range has passed the detection point is determined based on the positional relationship between the front end position of the train occupancy range and the detection point that is provided within the second block section adjacent to the first block section in the backward travel direction of the train. It is determined that the train that travels backward has left the first block section when it has been determined that the entirety of the train occupancy range has passed the detection point.

The occupancy detection device may further comprise:

a detection point setting section that determines a position of the detection point by determining a distance from the boundary to the detection point based on a distance from the installation point of the correction coil to the boundary.

According to the above configuration, the distance from the boundary between the first block section and the second block section to the detection point is determined based on the distance from the installation point of the correction coil to the boundary. The train occupancy range is determined based on the train position and a margin distance that allows a measurement error. It is considered that a measurement error of the train position is small immediately after the train has passed by the installation point of the correction coil, and increases as the travel distance after the train has passed by the installation point of the correction coil increases. Therefore, whether or not the train has left the first block section can be quickly and reliably determined by setting the detection point at a position based on the distance from the installation point of the correction coil to the boundary.

Exemplary embodiments of the invention are described below with reference to the drawings. Note that the invention is not limited to the following exemplary embodiments.

System Configuration

FIG. 1 illustrates an outline of a wireless train control system 1 according to one embodiment of the invention. The wireless train control system 1 detects whether or not each virtual block section obtained by virtually dividing a track is occupied by a train.

The wireless train control system 1 includes an onboard system 20 that is mounted on a train 10, and a ground system 30. The onboard system 20 and the ground system 30 can communicate with each other via wireless communication through a given communication channel including a wireless base station 40. A plurality of wireless base stations 40 are provided along a track R so that the track R is continuously included in the wireless communication area. Note that the communication channel may be implemented using a loop antenna or a leakage coaxial cable (LCX cable) provided along the track R instead of using a wireless base station.

The onboard system 20 measures the position (train position) of the train 10, and transmits the measured train position to the ground system 30 as train position information together with identification information (e.g., train ID) about the train 10. Note that the train position may be indicated by the distance (km) from the starting point along the track R, or may be indicated by the distance from the nearest station along the track R. It is advantageous that the train position be indicated by the distance from a given position along the track R.

The onboard system 20 corrects the train position when the train 10 has passed by a correction coil 50 (position correction coil) that is provided along the track R based on wireless communication with the correction coil 50.

The correction coil 50 may be configured using a transceiver coil in the same manner as a known track antenna, or may be configured using radio frequency identification (RFID). The onboard system 20 and the correction coil 50 communicate with each other via short-range wireless communication.

The ground system 30 manages whether or not each block section is occupied by the train 10 based on the train position information received from the onboard system 20.

The following description is given taking a double-track railway as an example while focusing on one of the tracks for convenience of explanation. Note that the invention may also be applied to a single-track railway, a four-track railway, and the like.

Principle (A) Onboard Position Detection

Figure 2:
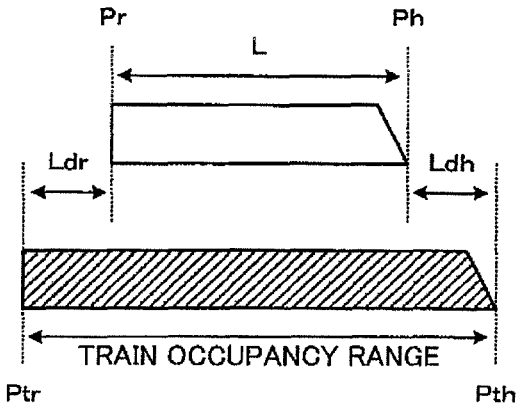
FIG. 2 is a view illustrating a train occupancy range.

The onboard system 20 detects the train position as described below. FIG. 2 is a view illustrating a train position detection process implemented by the onboard system 20. The onboard system 20 determines the train position by measuring the rotational speed of the wheel set, the axle, or the wheel that is detected using a tacho-generator, an axle pulse sensor, or the like. An example in which the rotational speed is detected using a tacho-generator is described below. Since the tacho-generator is provided at a fixed position, the relative distances from the front end and the rear end of the train are constant. Therefore, the front end position Ph and the rear end position Pr of the train 10 are calculated from the measured train position and the relative distances.

In one embodiment of the invention, the front end position Ph is used as the train position. Note that the rear end position Pr may also be used as the train position. Since the train has a constant train length L, the rear end position Pr is situated backward from the train position (front end position) Ph by the train length L.

A range calculated by adding a margin distance to the range specified by the positions Ph and Pr is set to be a train occupancy range in which the train 10 may be present, taking account of a measurement error due to the tacho-generator or the like. Specifically, the onboard system 20 calculates a position Pth situated forward from the train position (front end position) Ph by a forward margin distance Ldh, and calculates a position Ptr situated backward from the rear end position Pr by a backward margin distance Ldr. The range specified by the positions Pth and Ptr is set to be the train occupancy range. In one embodiment of the invention, the train occupancy range (i.e., the front end position Pth and the rear end position Ptr) is transmitted from the onboard system 20 to the ground system 30 as the train position information.

(B) Train Position Correction Using Correction Coil 50

A train position correction process that utilizes the correction coil 50 is described below. The onboard system 20 corrects the train position Ph when the train 10 has passed by the correction coil 50. More specifically, the onboard system 20 communicates with the correction coil 50 to acquire the installation position (absolute position) of the correction coil 50, and corrects the train position Ph based on the absolute position of the correction coil 50. The onboard system 20 also corrects the rear end position Pr and the train occupancy range based on the corrected train position Ph.

Figure 3:
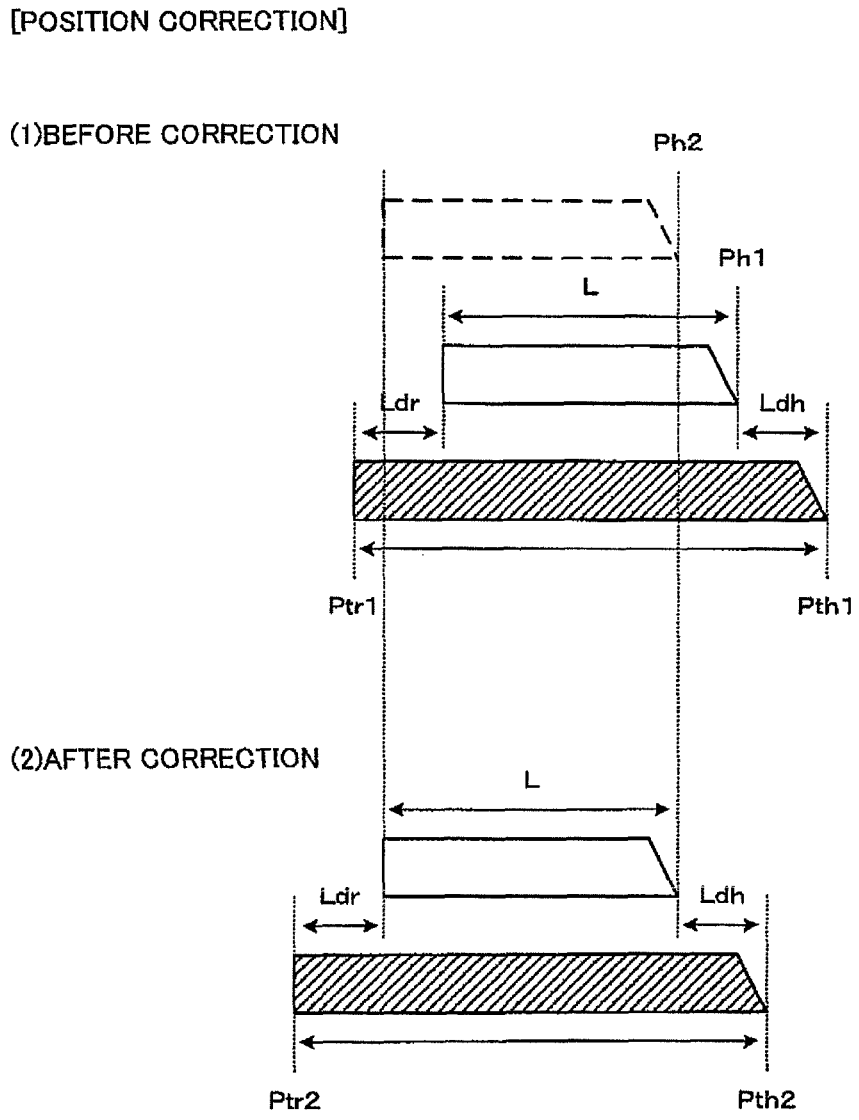
FIG. 3 is a view illustrating position correction that utilizes a correction coil.

FIG. 3 is a view illustrating the train position correction process that utilizes the correction coil 50. In FIG. 3, (1) indicates a state immediately before correction. In FIG. 3, the train figure indicated by the solid line indicates the measured train position, and the train figure indicated by the dotted line indicates the actual train position. As illustrated in FIG. 3, the measured train position Ph1 precedes the actual front end position Ph2. The train occupancy range is the range specified by the positions Pth1 and Ptr1.

(2) in FIG. 3 indicates a state in which the train position Ph has been corrected after the train has passed by the correction coil 50. Specifically, the train position has been corrected (changed) so that the train position Ph1 is shifted backward to the position Ph2. In this case, the train occupancy range is also corrected so that the train occupancy range is shifted backward to the range specified by the positions Pth2 and Ptr2 from the range specified by the positions Pth1 and Ptr1.

When the difference ΔPh (=|Ph1−Ph2|) between the train position Ph1 immediately before correction and the train position Ph2 immediately after correction exceeds a predetermined value, it is determined than an abnormality has occurred, and a given process (e.g., emergency stop) is performed. The backward margin distance Ldr is used as the predetermined value when the correction direction is the backward direction, and the forward margin distance Ldh is used as the predetermined value when the correction direction is the forward direction. Specifically, the maximum position correction distance when using the correction coil 50 is the forward margin distance Ldh when the correction direction is the forward direction, and is the backward margin distance Ldr when the correction direction is the backward direction.

(C) Problem that May Occur Due to Position Correction

A problem that may occur due to the train position correction process that utilizes the correction coil 50 is described below. The ground system 30 detects whether or not each block section is occupied by a train based on the train occupancy range received from the onboard system 20. Therefore, when the train position Ph has been shifted backward by the position correction process, a situation may occur in which the train that has completely entered one block section enters the identical block section again (or the train that has completely left one block section is positioned in the identical block section again) (i.e., the occupancy state changes).

Figure 4:
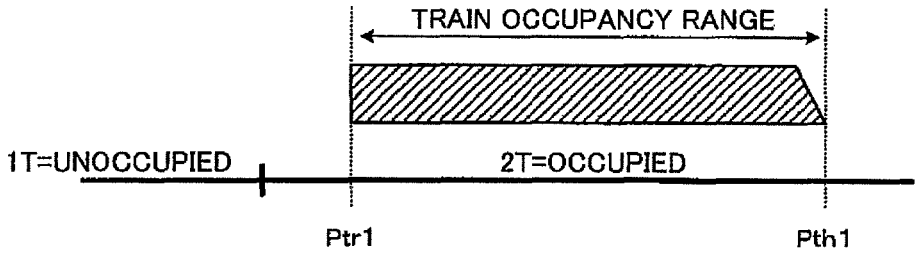
FIG. 4 is a view illustrating a problem that may occur due to position correction.
Figure 4:
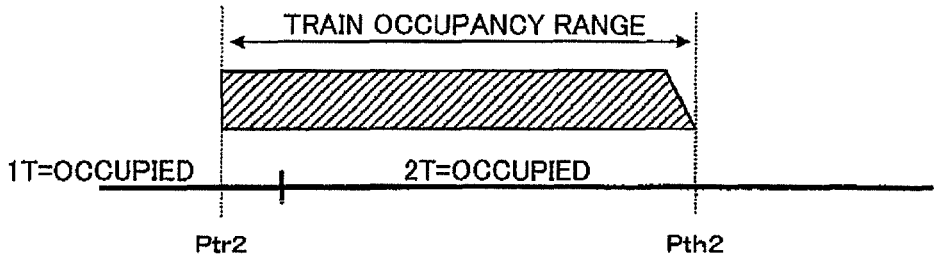

FIG. 4 is a view illustrating the above problem that may occur due to the train position correction process. FIG. 4 illustrates an example of an occupancy detection process performed by the ground system 30. The occupancy detection process is performed based on the train occupancy range. In FIG. 4, (1) indicates a state before correction. In this case, the train occupancy range received from the onboard system 20 is the range specified by the positions Pth1 and Ptr1. The positions Pth1 and Ptr1 belong to the block section 2T. Therefore, the block section 1T is not occupied, and the block section 2T is occupied in this state.

For example, the onboard system 20 then corrects the train position Ph backward after the train has passed by the correction coil 50, and the train occupancy range received from the onboard system 20 is specified by the positions Pth2 and Ptr2 (see (2) in FIG. 4) (i.e., the train occupancy range has been shifted backward). In this case, the front end position Pth2 belongs to the block section 2T, and the rear end position Ptr2 belongs to the block section 1T. Therefore, the block section 1T and the block section 2T are occupied in this state. Specifically, the ground system 30 may detect that the block section 1T that has been detected to be unoccupied by the train 10 that travels forward is occupied by the train 10 again.

Although FIG. 4 illustrates an example in which the rear end position Ptr of the train occupancy range is shifted backward across the boundary between the block sections, the same situation may also be applied to the front end position Pth.

(D) Detection of Unoccupancy

In one embodiment of the invention, an exit detection point Q is set at a position outside the block section, and it is determined that the train has left the block section when the entirety of the train occupancy range has passed the exit detection point Q. It is determined that the block section is not occupied when it has been determined that the train has left the block section.

Figure 5:
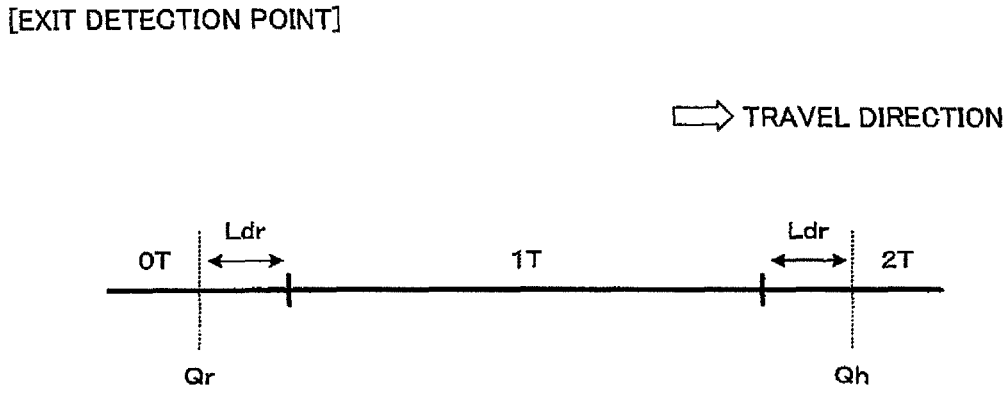
FIG. 5 is a view illustrating an exit detection point setting method.

FIG. 5 is a view illustrating the exit detection point that is set corresponding to the block section. In FIG. 5, the train travels in the rightward direction. As illustrated in FIG. 5, the exit detection point Q is set in order to determine whether or not the train has left the block section T. More specifically, a backward exit detection point Qr is set within the block section 0T that is adjacent to the block section 1T in the backward direction at a position away from the boundary between the block sections 0T and 1T by the backward margin distance Ldr. A forward exit detection point Qh is set within the block section 2T that is adjacent to the block section 1T in the forward direction at a position away from the boundary between the block sections 1T and 2T by the backward margin distance Ldr.

It is determined that the train has left the block section 1T when it has been detected that the train occupancy range of the train is situated outside the range specified by the exit detection points Qr and Qh. Specifically, when the train travels forward, it is determined that the train has left the block section 1T when it has been detected that the rear end position Ptr of the train occupancy range of the train has passed the exit detection point Qh. When the train travels backward, it is determined that the train has left the block section 1T when it has been detected that the front end position Pth of the train occupancy range of the train has passed the exit detection point Qr.

Figure 6:
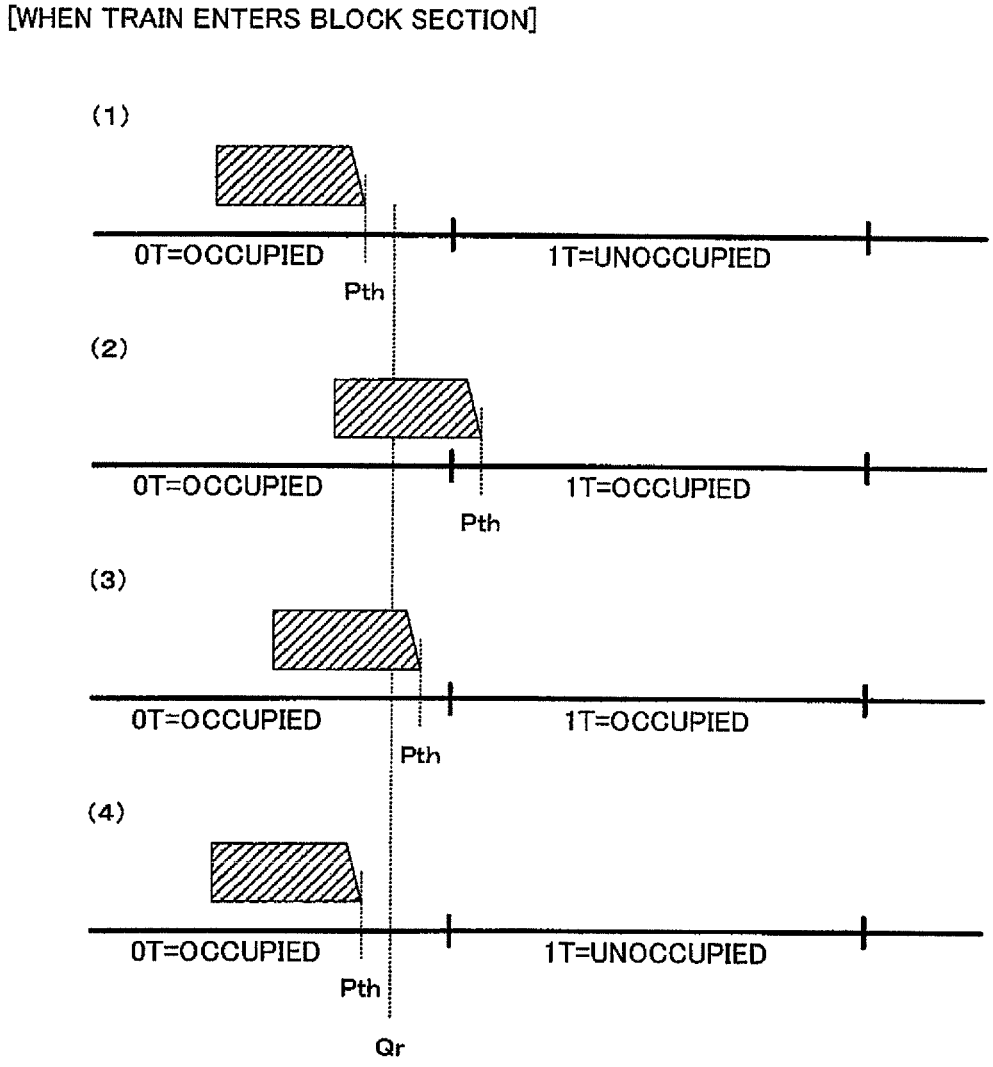
FIG. 6 is a view illustrating determination of an occupancy state when a train enters a block section.

FIG. 6 is a view illustrating the occupancy detection process when the train enters the block section 1T. In FIG. 6, the train travels in the rightward direction. The exit detection point Qr that corresponds to the block section 1T is set within the block section 0T that is adjacent to the block section 1T in the backward direction.

As indicated by (1) in FIG. 6, the train occupancy range is situated within the block section 0T. Therefore, it is determined that the block section 0T is occupied, and the block section 1T is not occupied. As indicated by (2) in FIG. 6, when the train occupancy range has been shifted forward, and the front end position Pth has passed the boundary between the block sections 0T and 1T, it is determined that the block section 1T is occupied.

As indicated by (3) in FIG. 6, the train occupancy range is then shifted backward, and the front end position Pth passes the boundary between the block sections 0T and 1T. In this case, since the front end position Pth has not passed the exit detection point Qr that corresponds to the block section 1T, it is determined that the train has not left the block section 1T, and the block section 1T remains occupied. Since the train occupancy range is shifted backward by the margin distance Ldr to a maximum when correcting the train position utilizing the correction coil 50, the front end position Pth may pass the boundary between the block sections 0T and 1T, and may be situated in the block section 0T again. However, the front end position Pth has not passed the exit detection point Qr in the situation indicated by (3) in FIG. 6.

As indicated by (4) in FIG. 6, when the train occupancy range has been further shifted backward, and the front end position Pth has passed the exit detection point Qr that corresponds to the block section 1T, it is determined that the train has left the block section 1T, and the block section 1T is not occupied. In this case, the train has traveled backward, and left the block section 1T.

Figure 7:
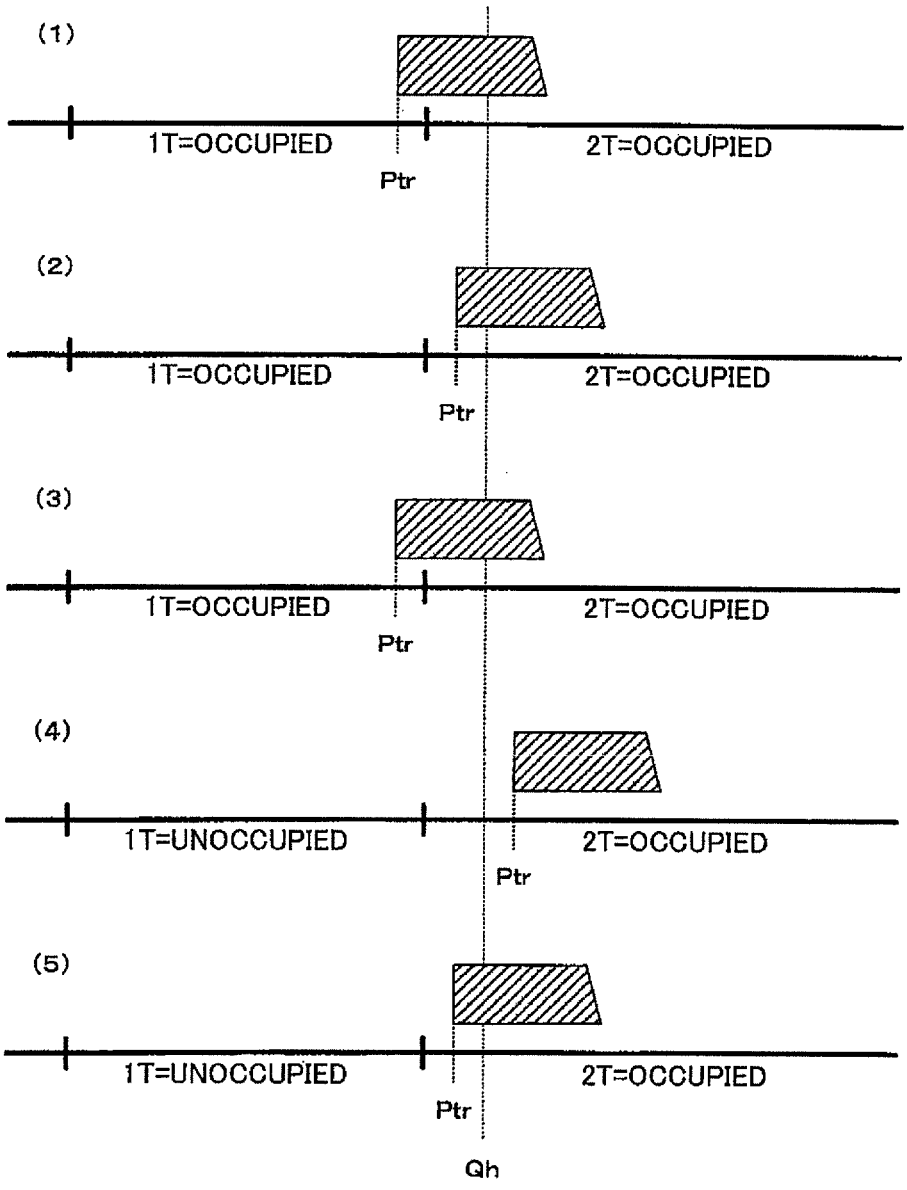
FIG. 7 is a view illustrating determination of an occupancy state when a train leaves a block section.

FIG. 7 is a view illustrating the occupancy detection process when the train leaves the block section 1T. In FIG. 7, the train travels in the rightward direction. The exit detection point Qh is set within the block section 2T that is adjacent to the block section 1T in the forward direction (travel direction).

As indicated by (1) in FIG. 7, the front end position Pth of the train occupancy range is situated within the block section 2T, and the rear end position Ptr is situated within the block section 1T. Therefore, it is determined that the block section 1T and the block section 2T are occupied.

As indicated by (2) in FIG. 7, the train occupancy range has been shifted forward, and the rear end position Ptr has passed the boundary between the block sections 1T and 2T. However, the rear end position Ptr has not passed the exit detection point Qh. Specifically, since the rear end position Ptr is situated between the boundary between the block sections 1T and 2T and the exit detection point Qh, it is determined that the train has not left the block section 1T, and the block section 1T remains occupied.

As indicated by (3) in FIG. 7, the train occupancy range has been corrected backward due the position correction process that utilizes the correction coil 50. Since the train occupancy range is shifted backward by the margin distance Ldr to a maximum when correcting the train position utilizing the correction coil 50, the rear end position Ptr may pass the boundary between the block sections 1T and 2T, and may be situated in the block section 1T again.

As indicated by (4) in FIG. 7, when the train occupancy range has been shifted forward, and the rear end position Ptr has passed the exit detection point Qh that corresponds to the block section 1T, it is determined that the train has left the block section 1T, and the block section 1T is not occupied. As indicated by (5) in FIG. 7, the rear end position Ptr does not pass the boundary between the block sections 1T and 2T even if the train occupancy range is shifted backward due the position correction process that utilizes the correction coil 50.

Configuration of Onboard System

Figure 8:
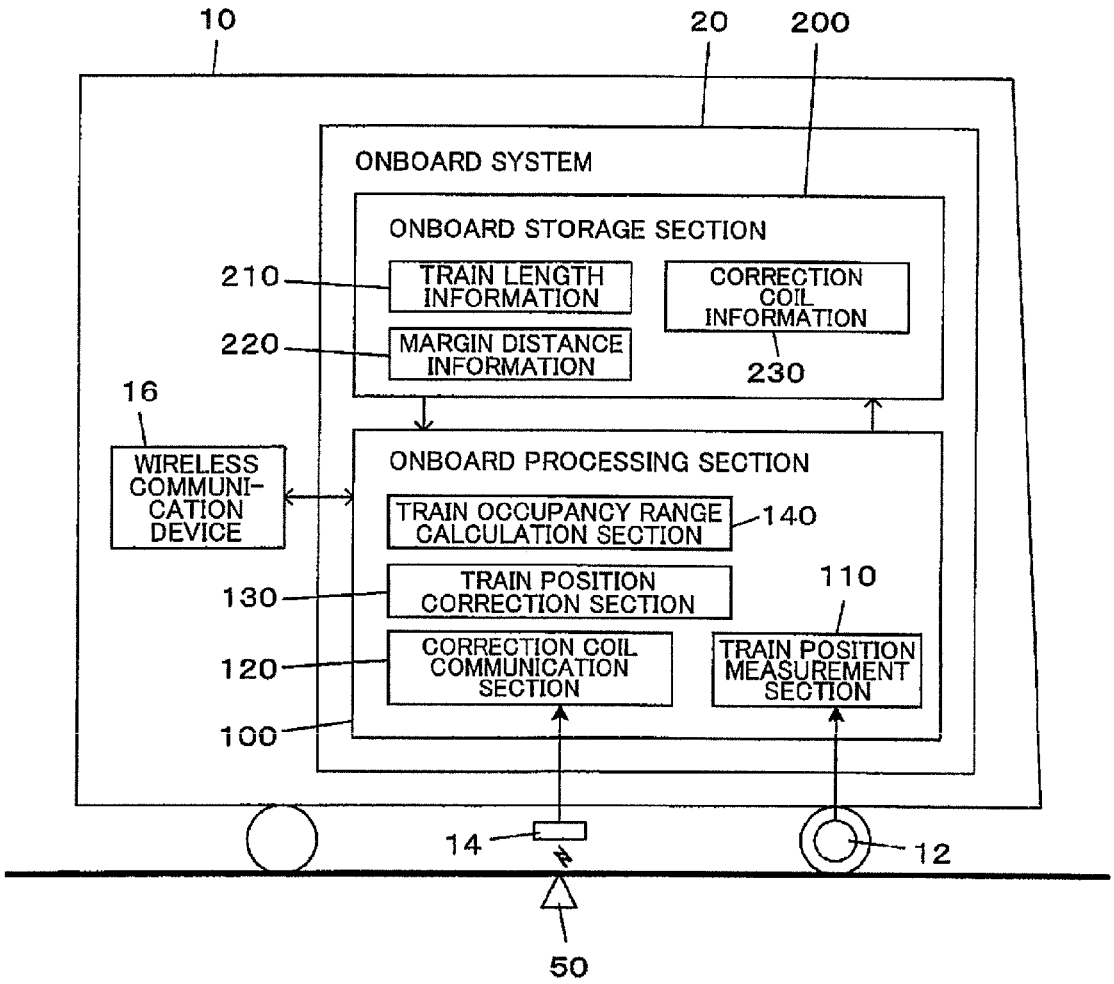
FIG. 8 is a view illustrating the configuration of an onboard system.

FIG. 8 is a view illustrating the configuration of the onboard system 20. As illustrated in FIG. 8, the onboard system 20 includes an onboard processing section 100 and an onboard storage section 200.

The onboard processing section 100 is implemented by a processor (e.g., CPU), for example. The onboard processing section 100 controls the entire onboard system 20 based on a program and data stored in the onboard storage section 200, data received via a wireless communication device 16, and the like. The onboard processing section 100 includes a train position measurement section 110, a correction coil communication section 120, a train position correction section 130, and a train occupancy range calculation section 140.

The train position measurement section 110 measures the position of the train based on the measured rotational speed of a tacho-generator 12 attached to the axle.

The correction coil communication section 120 acquires correction coil ID that identifies the correction coil 50 from the correction coil 50 via a receiver 14 that communicates with the correction coil 50 when the train passes by the installation point of the correction coil 50. The correction coil 50 and the receiver 14 communicate with each other via short-range wireless communication. The maximum communication range is about 20 cm to about 1 m, and an error of the train position due to the communication range can be disregarded.

The train position correction section 130 corrects the train position measured by the train position measurement section 110 based on the communication results of the correction coil communication section 120. More specifically, the train position correction section 130 identifies the correction coil 50 based on the correction coil ID acquired by the correction coil communication section 120 when the train passes by the installation point of the correction coil 50, and corrects the measured train position using the corresponding absolute position. The relationship between the correction coil 50 and the installation position is provided as correction coil information 230.

The train occupancy range calculation section 140 calculates the train occupancy range (in which the train may be present) using the train position. More specifically, the train occupancy range calculation section 140 determines the position situated backward from the train position Ph by the train length L to be the rear end position Pr. The train occupancy range calculation section 140 then calculates the position Pth situated forward from the train position Ph by the forward margin distance Ldh, and calculates the position Ptr situated backward from the rear end position Pr by the backward margin distance Ldr. The range specified by the positions Pth and Ptr is set to be the train occupancy range.

Note that the train length L is stored as train length information 210. The forward margin distance Ldh and the backward margin distance Ldr are stored as margin distance information 220.

In one embodiment of the invention, the forward margin distance Ldh and the backward margin distance Ldr are fixed values. Note that the forward margin distance Ldh and the backward margin distance Ldr may be set to be variable. When the forward margin distance Ldh and the backward margin distance Ldr are set to be variable, the forward margin distance Ldh and the backward margin distance Ldr are calculated based on the travel distance after the train has passed by the installation point of the correction coil 50. Specifically, it is considered that a measurement error of the train position measured by the train position measurement section 110 increases as the travel distance from the installation point of the correction coil 50 increases. Therefore, the forward margin distance Ldh and the backward margin distance Ldr are calculated so that the forward margin distance Ldh and the backward margin distance Ldr are proportional to the travel distance. Note that the forward margin distance Ldh and the backward margin distance Ldr may be calculated so that the forward margin distance Ldh and the backward margin distance Ldr increase as the elapsed time after the train has passed by the installation point of the correction coil 50 increases.

The onboard storage section 200 is implemented by a storage device (e.g., ROM, RAM, or hard disk). The onboard storage section 200 stores a system program that causes the onboard processing section 100 to integrally control the onboard system 20, a program and data for implementing various functions, and the like. The onboard storage section 200 is used as a work area for the onboard processing section 100, and temporarily stores the results of calculations performed by the onboard processing section 100, data received via the wireless communication device 16, and the like. In one embodiment of the invention, the onboard storage section 200 stores the train length information 210, the correction coil information 230, and the margin distance information 220.

Configuration of Ground System

Figure 9:
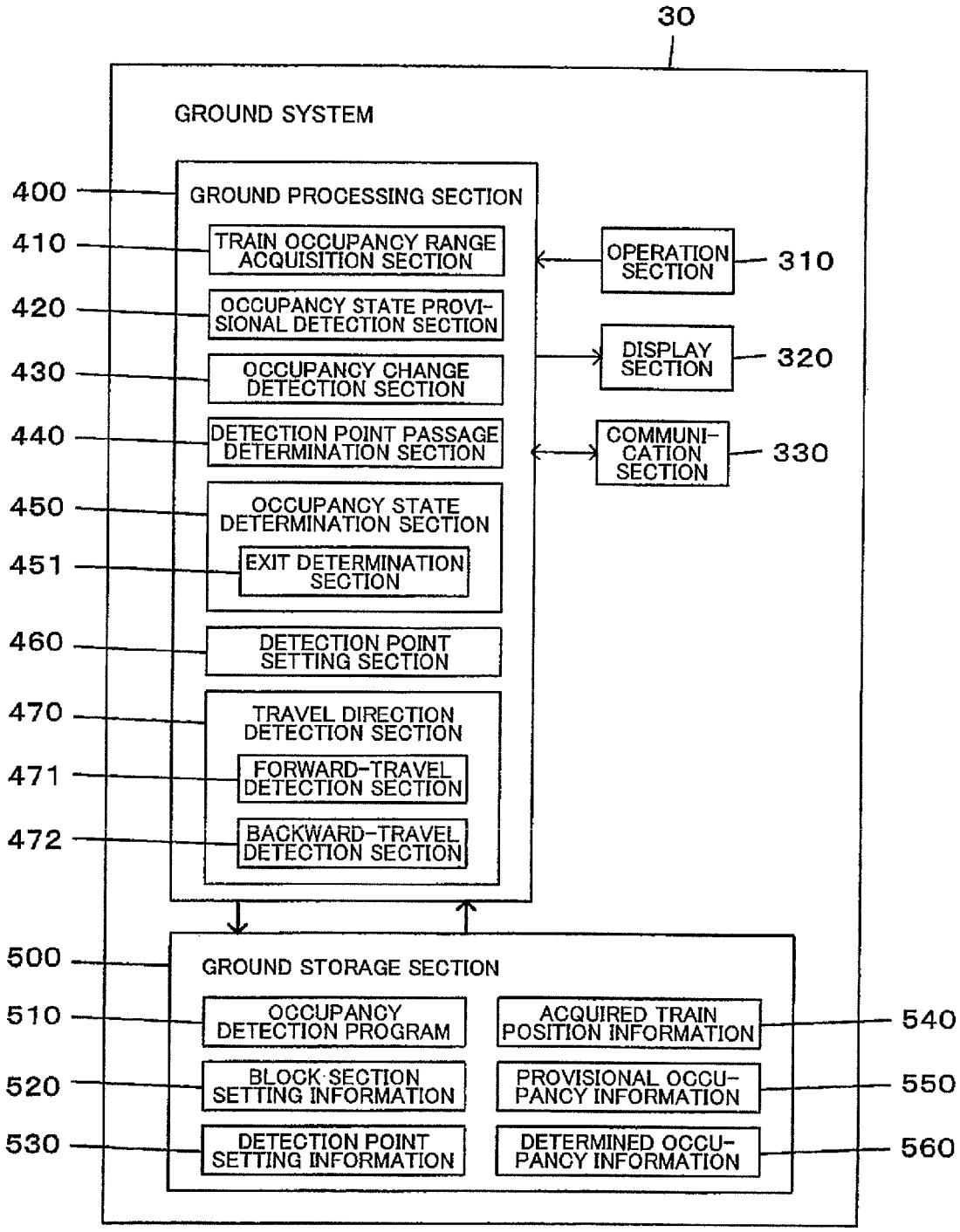
FIG. 9 is a view illustrating the configuration of a ground system.

FIG. 9 is a view illustrating the configuration of the ground system 30. As illustrated in FIG. 6, the ground system 30 includes an operation section 310, a display section 320, a communication section 330, a ground processing section 400, and a ground storage section 500. Note that the configuration of the ground system 30 illustrated in FIG. 9 is merely an example, and the ground system 30 may further include an additional element.

The operation section 310 is implemented by an input device (e.g., button switch, keyboard, or touch panel), and outputs an operation signal corresponding to the operation by the user to the ground processing section 400.

The display section 320 is implemented by a display (e.g., liquid crystal display (LCD)), and displays an image corresponding to a display signal input from the ground processing section 400.

The communication section 330 connects to a given communication channel through the wireless base station 40, and controls wireless communication with an external device such as the onboard system 20.

The ground processing section 400 is implemented by a processor (e.g., CPU), for example. The ground processing section 400 controls the entire ground system 30 based on a program and data stored in the ground storage section 500, data received via the wireless communication device 16, and the like. The ground processing section 400 includes a train occupancy range acquisition section 410, an occupancy state provisional detection section 420, an occupancy change detection section 430, a detection point passage determination section 440, an occupancy state determination section 450, a detection point setting section 460, and a travel direction detection section 470.

The train occupancy range acquisition section 410 acquires the train occupancy range (in which the train may be present) from the onboard system 20 of each train 10. The train occupancy range acquired by the train occupancy range acquisition section 410 is stored as acquired train position information 540.

The occupancy state provisional detection section 420 provisionally detects the occupancy state of each block section based on the train occupancy range acquired by the train occupancy range acquisition section 410. More specifically, the occupancy state provisional detection section 420 provisionally detects that the detection target block section is occupied when the train occupancy range is situated within the detection target block section. The occupancy state provisional detection section 420 provisionally detects that the detection target block section is not occupied when the train occupancy range is not situated within the detection target block section. Note that it is determined that the train occupancy range is situated within the detection target block section even when only part of the train occupancy range overlaps the block section.

The block section setting information is provided as block section setting information 520. FIG. 10 is a view illustrating an example of the data configuration of the block section setting information 520. As illustrated in FIG. 10, the block section setting information 520 includes a block section 521, a start point position 522, and an end point position 523. The block section setting information 520 is basically fixed.

The detection result of the occupancy state provisional detection section 420 is stored as provisional occupancy information 550. FIG. 11 is a view illustrating an example of the data configuration of the provisional occupancy information 550. As illustrated in FIG. 11, the provisional occupancy information 550 includes a block section 551, and a provisional occupancy state 552 that has been provisionally detected.

The occupancy change detection section 430 detects a change in occupancy state of each block section. More specifically, the occupancy change detection section 430 detects whether or not the occupancy state of the detection target block section has changed from the occupancy state (determined occupancy information 560) detected by the occupancy state determination section 450 to the occupancy state (provisional occupancy information 550) detected by the occupancy state provisional detection section 420. The occupancy change detection section 430 detects the state "still occupied", "still unoccupied", "occupied→unoccupied", or "unoccupied→occupied".

The detection point passage determination section 440 determines whether or not the train has passed the exit detection points Qh and Qr that are set by the detection point setting section 460 corresponding to each block section. More specifically, the detection point passage determination section 440 determines whether or not the entirety of the train occupancy range of the train has passed the exit detection point Qh by comparing the exit detection point Qh that corresponds to the detection target block section with the rear end position Ptr of the train (forward-travel train) that has been detected to travel forward by a forward-travel detection section 471. The detection point passage determination section 440 determines that the train has passed the exit detection point Qh when the rear end position Ptr that has been situated on the backward side of the exit detection point Qh is situated on the forward side of the exit detection point Qh.

The detection point passage determination section 440 determines whether or not the entirety of the train occupancy range of the train has passed the exit detection point Qr by comparing the exit detection point Qr that corresponds to the detection target block section with the front end position Pr of the train (backward-travel train) that has been detected to travel backward by a backward-travel detection section 472. The detection point passage determination section 440 determines that the train has passed the exit detection point Qr when the front end position Pth that has been situated on the forward side of the exit detection point Qr is situated on the backward side of the exit detection point Qr.

The occupancy state determination section 450 includes an exit determination section 451, and detects the occupancy state of each block section using the provisional detection result of the occupancy state provisional detection section 420 and the determination result of the exit determination section 451.

The exit determination section 451 determines whether or not the train has left each block section. More specifically, the exit determination section 451 determines that the train has left the detection target block section when the detection point passage determination section 440 has determined that the forward-travel train has passed the exit detection point Qh that corresponds to the detection target block section. The exit determination section 451 determines that the train has left the detection target block section when the detection point passage determination section 440 has determined that the backward-travel train has passed the exit detection point Qr that corresponds to the detection target block section.

The occupancy state determination section 450 determines that the detection target block section is occupied when the provisional detection result indicates that the block section is occupied. When the provisional detection result indicates that the block section is not occupied, the occupancy state determination section 450 detects the occupancy state of the detection target block section using the determination result of the exit determination section 451. Specifically, when the provisional detection result indicates the state "occupied→unoccupied", and the determination result of the exit determination section 451 indicates that the train has left the detection target block section, the occupancy state determination section 450 determines that the detection target block section is not occupied. When the provisional detection result indicates the state "still unoccupied", the occupancy state determination section 450 also determines that the detection target block section is not occupied.

The detection result of the occupancy state determination section 450 is stored as the determined occupancy information 560. FIG. 12 is a view illustrating an example of the data configuration of the determined occupancy information 560. As illustrated in FIG. 12, the determined occupancy information 560 includes a block section 561, and a determined occupancy state 562 that has been determined (detected).

The detection point setting section 460 sets the exit detection points Qh and Qr corresponding to each block section. More specifically, the detection point setting section 460 sets the exit detection point Qr on the backward side of the detection target block section at a position away from the boundary between the detection target block section and the block section adjacent to the detection target block section by the backward margin distance Ldr. The detection point setting section 460 sets the exit detection point Qh on the forward side of the detection target block section at a position away from the boundary between the detection target block section and the block section adjacent to the detection target block section by the backward margin distance Ldr.

The margin distance Ldr may be a fixed value, or may be set to be variable. When the margin distance Ldr is set to be variable, the margin distance Ldr is determined based on the travel distance or the elapsed time after the train 10 has passed by the installation point of the correction coil 50. Since the position of the correction coil 50 and the position of the boundary between adjacent block sections are fixed, the positions of the exit detection points Qh and Qr are also fixed. Specifically, the positions of the exit detection points Qh and Qr are determined by determining the distances from the boundary between adjacent block sections to the exit detection points Qh and Qr based on the distance from the installation point of the correction coil 50 to the boundary between adjacent block sections. For example, the distance from the boundary between the detection target block section 1T and the block section 0T that is adjacent to the block section 1T in the backward direction to the exit detection point Qr is determined corresponding to the distance from the installation point of the correction coil 50 (that is situated at the nearest position in the backward direction) to the boundary between the block section 1T and the block section 0T (see FIG. 5). The distance from the boundary between the detection target block section 1T and the block section 2T that is adjacent to the block section 1T in the forward direction to the exit detection point Qh is determined corresponding to the distance from the installation point of the correction coil 50 (that is situated at the nearest position in the backward direction) to the boundary between the block section 1T and the block section 2T.

FIG. 13 is a view illustrating an example of the data configuration of the detection point setting information 530. As illustrated in FIG. 13, the detection point setting information 530 includes a block section 531, a backward exit detection point Qr 532 (that is used to determine whether or not the train that travels backward has left the block section), and a forward exit detection point Qh 533 (that is used to determine whether or not the train that travels forward has left the block section).

The travel direction detection section 470 includes the forward-travel detection section 471 and the backward-travel detection section 472, and determines the travel direction of the train based on a change in the train occupancy range acquired by the train occupancy range acquisition section 410. The forward-travel detection section 471 detects whether or not the train travels forward based on a change in the train occupancy range. The backward-travel detection section 472 detects whether or not the train travels backward based on a change in the train occupancy range.

The ground storage section 500 is implemented by a storage device (e.g., ROM, RAM, or hard disk). The ground storage section 500 stores a system program that causes the ground processing section 400 to integrally control the ground system 30, a program and data for implementing various functions, and the like. The ground storage section 500 is used as a work area for the ground processing section 400, and temporarily stores the results of calculations performed by the ground processing section 400, data received via the wireless communication device 16, and the like. In one embodiment of the invention, the ground storage section 500 stores an occupancy detection program 510, the block section setting information 520, the detection point setting information 530, the acquired train position information 540, the provisional occupancy information 550, and the determined occupancy information 560.

Process Flow

Figure 14:
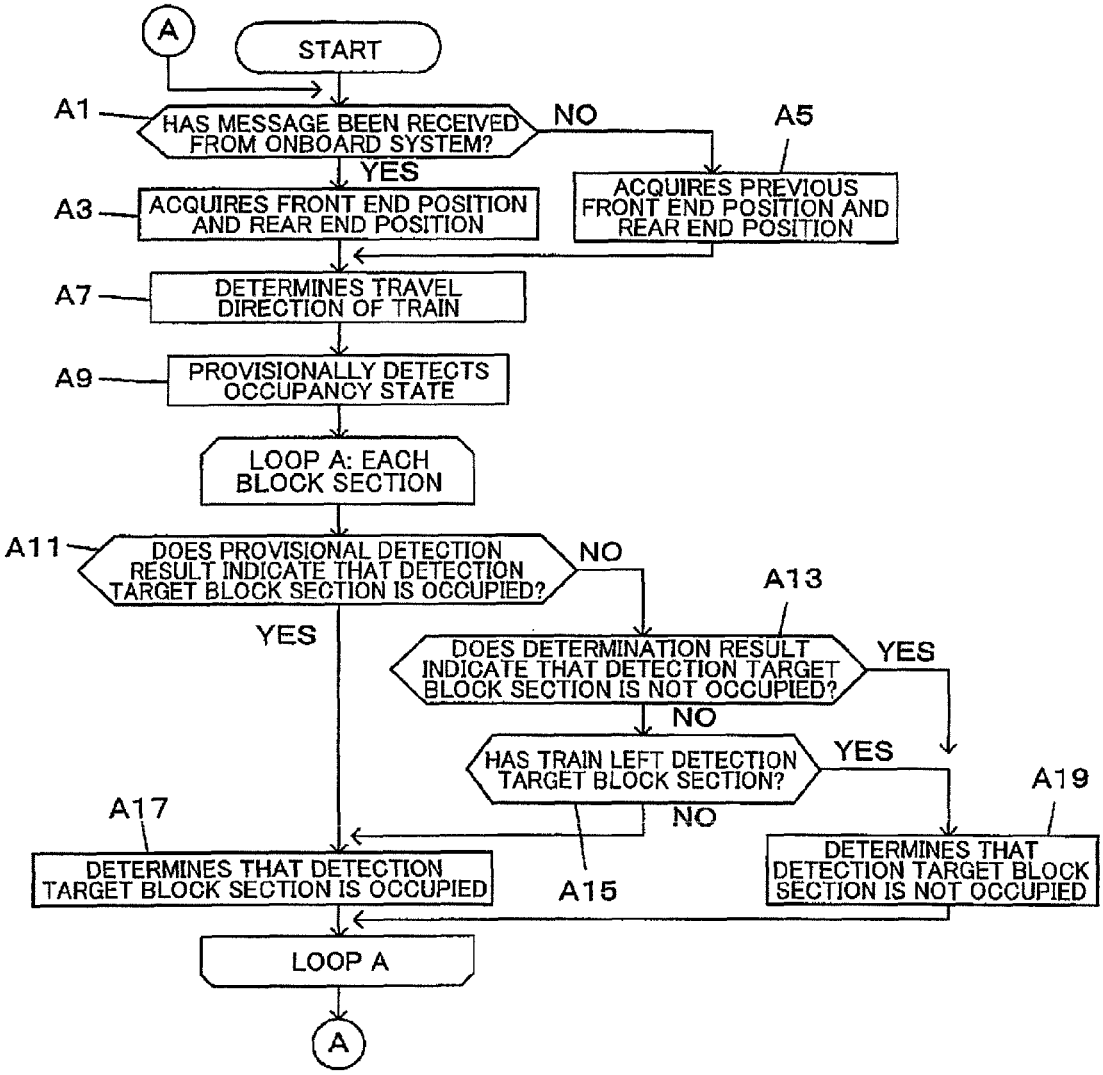
FIG. 14 is a flowchart illustrating an occupancy detection process.

FIG. 14 is a flowchart illustrating an occupancy detection process performed by the ground system 30. The occupancy detection process is implemented by causing the ground processing section 400 to execute the occupancy detection program 510.

When a message has been received from the onboard system 20 of the train (step A1: YES), the train occupancy range acquisition section 410 acquires the train occupancy range (front end position Pth and rear end position Ptr) included in the received message (step A3). When a message has not been received from the onboard system 20 of the train (step A1:

NO), the train occupancy range acquisition section 410 acquires the previous train occupancy range (step A5).

The travel direction detection section 470 determines the travel direction of the train based on the front end position Pth and the rear end position Ptr acquired by the train occupancy range acquisition section 410 (step A7). The occupancy state provisional detection section 420 provisionally detects the occupancy state based on the train occupancy range acquired by the train occupancy range acquisition section 410 (step A9).

A loop A process is then performed on each block section. In the loop A process, the occupancy state determination section 450 determines the occupancy state of the detection target block section. More specifically, when the provisional detection result indicates that the detection target block section is occupied (step A11: YES), the occupancy state determination section 450 determines that the detection target block section is occupied (step A17).

When the provisional detection result indicates that the detection target block section is not occupied (step A11: NO), the occupancy state determination section 450 determines the previous occupancy state of the detection target block section. When the previous occupancy state is an occupied state (step A13: NO), and the exit determination section 451 has determined that the train has not left the detection target block section (step A15: NO), the occupancy state determination section 450 determines that the detection target block section is occupied (step A17). When the previous occupancy state is an occupied state (step A13: NO), and the exit determination section 451 has determined that the train has left the detection target block section (step A15: YES), the occupancy state determination section 450 determines that the detection target block section is not occupied (step A19).

When the previous occupancy state is an unoccupied state (step A13: YES), the occupancy state determination section 450 determines that the detection target block section is not occupied (step A19). The loop A process is performed as described above.

When the loop A process has been performed on each block section, the process is repeated from the step A1.

Advantageous Effects

The wireless train control system 1 according to one embodiment of the invention is configured so that the onboard system 20 transmits the train occupancy range based on the measured train position to the ground system 30. The ground system 30 provisionally detects the occupancy state of each block section based on the train occupancy range acquired from the onboard system 20. The exit detection points Qh and Qr are set corresponding to each block section at a position outside each block section. It is determined that the train has left the block section when the entirety of the train occupancy range has passed the exit detection point Qh or Qr. When the provisional detection result indicates that the detection target block section is not occupied, and it has been determined that the train has left the detection target block section, it is determined that the detection target block section is not occupied. This prevents a situation in which the block section that has been detected to be unoccupied by the train that travels forward is occupied by the train again due to backward position correction using the correction coil 50.

Modifications

The invention is not limited to the above embodiments. Various modifications and variations may be appropriately made without departing from the scope of the invention.

(A) Calculation of Train Occupancy Range

The onboard system 20 may transmit the train position instead of the train occupancy range. In this case, the ground system 30 receives the train position from the onboard system 20. The train occupancy range acquisition section 410 calculates the train occupancy range based on the received train position.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. An occupancy detection device that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection device comprising:

an acquisition section that acquires a train occupancy range that is determined based on the train position, the train occupancy range being a range in which the train may be present and being defined by a length of the train, a forward margin distance and a backward margin distance;

a provisional detection section that provisionally detects the occupancy state of each block section based on the train occupancy range;

a detection point passage determination section that determines whether or not the entirety of the train occupancy range has passed a detection point that is provided within a second block section adjacent to a first block section at a position away from a boundary between the first block section and the second block section by a given distance; and a determination section that determines the occupancy state of the first block section using a detection result of the provisional detection section and a determination result of the detection point passage determination section.

2. The occupancy detection device as defined in claim 1, further comprising:

an occupancy change detection section that detects whether or not the provisional detection section has detected that the occupancy state of the first block section has changed from an occupied state to an unoccupied state, the determination section including an exit determination section that 1) determines that the train has not left the first block section when the detection point passage determination section has determined that the entirety of the train occupancy range has not passed the detection point, and 2) determines that the train has left the first block section when the detection point passage determination section has determined that the entirety of the train occupancy range has passed the detection point, after the occupancy change detection section has detected that the provisional detection section has detected that the occupancy state of the first block section has changed from the occupied state to the unoccupied state, and the determination section determining that the first block section is occupied until the exit determination section determines that the train has left the first block section after the occupancy change detection section has detected that the provisional detection section has detected that the occupancy state of the first block section has changed from the occupied state to the unoccupied state.

3. The occupancy detection device as defined in claim 2, the second block section being a block section that is adjacent to the first block section in a forward travel direction of the train, the occupancy detection device further comprising a forward-travel detection section that detects whether or not the train travels forward based on a change in the train occupancy range, the detection point passage determination section determining whether or not the entirety of the train occupancy range has passed the detection point based on the occupancy state of the second block section detected by the provisional detection section, and a positional relationship between a rear end position of the train occupancy range and the detection point, and the exit determination section determining whether or not the train that travels forward has left the first block section.

4. The occupancy detection device as defined in claim 2, the second block section being a block section that is adjacent to the first block section in a backward travel direction of the train, the occupancy detection device further comprising a backward-travel detection section that detects whether or not the train travels backward based on a change in the train occupancy range, the detection point passage determination section determining whether or not the entirety of the train occupancy range has passed the detection point based on the occupancy state of the second block section detected by the provisional detection section, and a positional relationship between a front end position of the train occupancy range and the detection point, and the exit determination section determining whether or not the train that travels backward has left the first block section.

5. The occupancy detection device as defined in claim 1, further comprising:

a detection point setting section that determines a position of the detection point by determining a distance from the boundary to the detection point based on a distance from the installation point of the correction coil to the boundary.

6. An occupancy detection method that detects an occupancy state of each block section by a train, each block section being obtained by dividing a track, a correction coil being installed along the track, and the train including a measurement section that measures a train position, a correction coil communication section that communicates with the correction coil when the train passes by an installation point of the correction coil, and a correction section that corrects the train position based on a communication result of the correction coil communication section, the occupancy detection method comprising:

provisionally detecting the occupancy state of each block section based on a train occupancy range that is determined based on the train position, the train occupancy range being a range in which the train may be present and being defined by a length of the train, a forward margin distance and a backward margin distance;

determining whether or not the entirety of the train occupancy range has passed a detection point that is provided within a second block section adjacent to a first block section at a position away from a boundary between the first block section and the second block section by a given distance; and determining the occupancy state of the first block section using a result of the provisionally detection and a determination result as to whether or not the entirety of the train occupancy range has passed a detection point.

7. An occupancy detection system that detects an occupancy state of each block section by a train, comprising:

a track having a plurality of block sections, each track having at least one detection point located at a given distance from a boundary with an adjacent track section;

a correction coil being installed along the track;

the train including a measurement section that measures a train position, a correction coil communication section that communicates with the correction coil when the train passes by an installation point of the correction coil, and a correction section that corrects the train position based on a communication result of the correction coil communication section; and an occupancy detection device including:

an acquisition section that acquires a train occupancy range that is determined based on the train position, the train occupancy range being a range in which the train may be present and being defined by a length of the train, a forward margin distance and a backward margin distance;

a provisional detection section that provisionally detects the occupancy state of each block section based on the train occupancy range;

a detection point passage determination section that determines whether or not the entirety of the train occupancy range has passed the detection point of a subsequent block section; and a determination section that determines the occupancy state of a previous block section using a detection result of the provisional detection section and a determination result of the detection point passage determination section.

* * * * *